US006955500B1

(12) United States Patent
Smith et al.

(10) Patent No.: US 6,955,500 B1
(45) Date of Patent: Oct. 18, 2005

(54) METHOD OF FORMING A MAT OF EROSION CONTROL BLOCKS

(75) Inventors: Lee A. Smith, Houston, TX (US); Belinda F. Smith, Houston, TX (US); James S. Kole, Jr., Dallas, TX (US)

(73) Assignee: Erosion Prevention Products, LLC, Houston, TX (US)

( * ) Notice: Subject to any disclaimer, the term of this patent is extended or adjusted under 35 U.S.C. 154(b) by 0 days.

(21) Appl. No.: 10/780,433

(22) Filed: Feb. 17, 2004

(51) Int. Cl.[7] ..... E02B 3/14
(52) U.S. Cl. ..... 405/20; 405/17
(58) Field of Search ..... 405/16, 17, 19, 405/20

(56) References Cited

U.S. PATENT DOCUMENTS

| | | | | |
|---|---|---|---|---|
| 1,987,150 | A * | 1/1935 | Mason | 405/20 |
| 1,993,217 | A * | 3/1935 | Mason | 405/20 |
| 4,152,875 | A * | 5/1979 | Soland | 405/19 |
| 4,375,928 | A | 3/1983 | Crow et al. | |
| 4,683,156 | A | 7/1987 | Waters | |
| 5,020,938 | A | 6/1991 | Scales | |
| 5,250,340 | A | 10/1993 | Bohnhoff | |
| 5,288,165 | A | 2/1994 | Douwes Dekker | |
| 5,556,228 | A | 9/1996 | Smith | |
| 5,779,391 | A * | 7/1998 | Knight | 405/20 |
| 6,276,870 | B1 | 8/2001 | Smith | |
| 6,666,619 | B2 * | 12/2003 | Yang | 405/16 |

OTHER PUBLICATIONS

Channel-Lock—Flexible Concrete Revetment brochure—4 pages, undated.

* cited by examiner

*Primary Examiner*—Frederick L. Lagman
(74) *Attorney, Agent, or Firm*—Chauza & Handley, LLP; Roger N. Chauza

(57) ABSTRACT

A method of cabling erosion control blocks of a mat together. The blocks have formed therein cable channels in a cris-cross manner, diagonally between the corners of each block. Cables are threaded through the blocks in a zig-zag manner, from the top of the mat to the bottom of the mat. The ends of the cables are terminated at two opposing sides of the mat so that the mat can be lifted by a spreader bar. The cables at the other two opposing sides of the mat are terminated for attachment to adjacent mats.

22 Claims, 7 Drawing Sheets

60
40
14
36
30
16
44
38
32
46
22
12
18
28
62

10
40
50
48
14
36
30
16
44
52
38
32
54
55
24
22
12
46
18
34
28
20
42

FIG. 9a
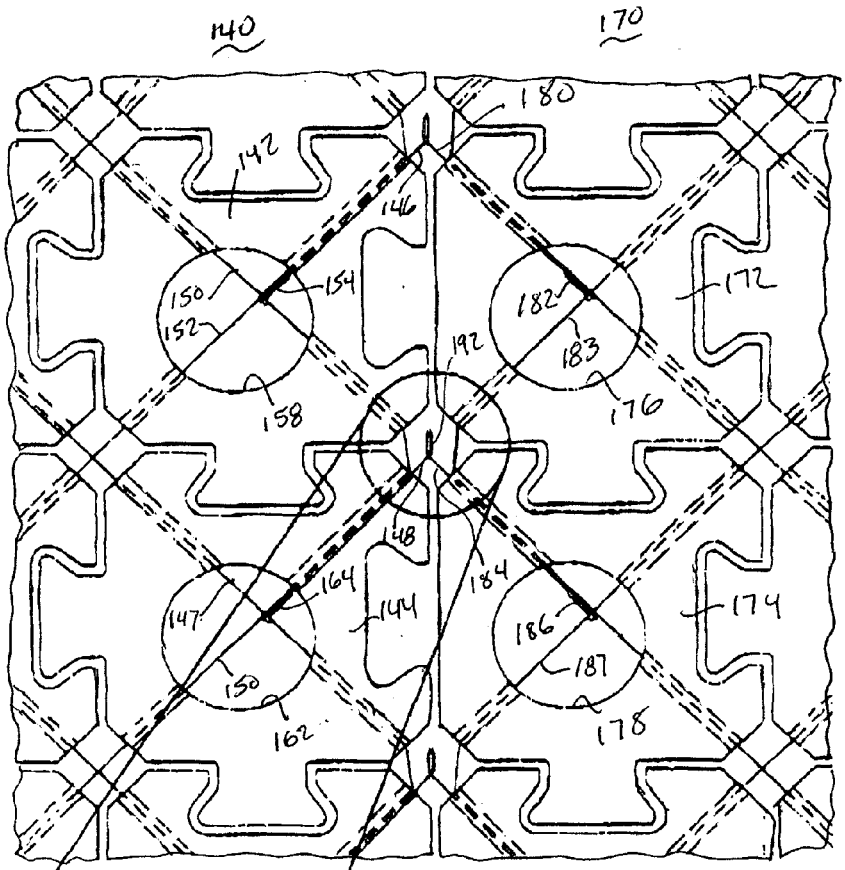
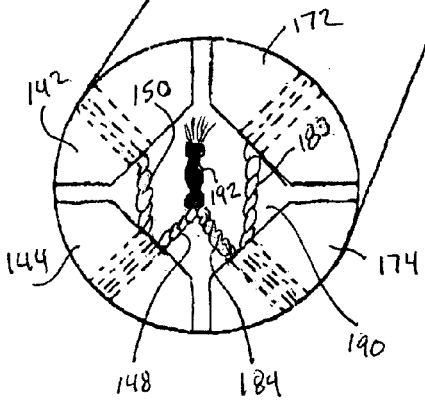
FIG. 9b
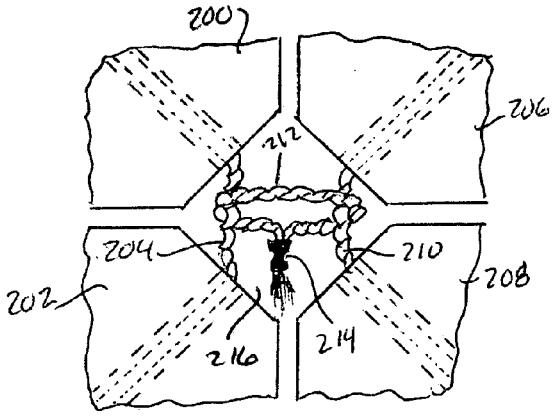
FIG. 10

METHOD OF FORMING A MAT OF EROSION CONTROL BLOCKS

TECHNICAL FIELD OF THE INVENTION

The present invention relates in general to erosion control blocks, and more particularly to a method of cabling together a number of erosion control blocks to form a stable mat.

BACKGROUND OF THE INVENTION

The erosion of soil, sand and other earth material has been controlled for many years by the use of erosion control blocks. The prior art is replete with erosion control blocks of all types, shapes and sizes. The primary function of erosion control blocks is to partially cover the ground to be protected and slow the flow of water thereover. A porous geotextile fabric is first laid on the ground. Depending on the area of the ground to be protected, the erosion control blocks can simply be hand laid on the fabric close together so that the weight of the blocks prevents shifting thereof under heavy water flow conditions. If the erosion control blocks have openings formed from the top to the bottom thereof, then eventually vegetation can grow through the openings and further anchor the blocks to the ground.

In other applications, the erosion control blocks are used in water channels or watershed areas that carry water on a normal basis. In this instance the blocks cannot be hand laid, except with the use of divers. More generally, erosion control blocks are cabled together into mats at the site and then lifted by a crane and lowered into the underwater location. In this case, divers may have to secure the edges of the adjacent mats together to form a single wide area mat. Mats of erosion control blocks can also be cabled together at a plant and transported to the site where a crane lifts the mats from a truck and lowers them into the area to be protected. Because the blocks are cabled together, a large volume of fast moving water can be accommodated without erosion of the underlying soil.

When a mat of erosion control blocks are cabled together and lifted by a crane, or the like, the mat bows downwardly in the middle. As can be appreciated, the cabled blocks tend to migrate downwardly to the middle of the mat due to the weight of the individual blocks. It is crucial that the blocks of the mat do not engage each other in such a manner that they become cracked, chipped or broken. This is especially important with blocks that otherwise interlock with each other, such as the type disclosed in U.S. Pat. No. 5,556,228 by Smith. It is important that a mat of such type of interlocking erosion control blocks be cabled and lifted without undue twisting or turning of the blocks on the supporting cables. If the blocks are subjected to torsional forces while being interlocked, such as when lifted in a mat, then the arms and/or sockets of the individual blocks can be damaged or broken. Damaged or broken blocks of a mat compromise the structural integrity of the mat. Moreover, it is time consuming and expensive to uncable a mat and replace or repair damaged blocks.

It has been an established practice to form the erosion control blocks with two or four cable channels therethrough. When two cable channels are formed in the blocks, then they are generally formed orthogonal to each other (North-South and East-West) so that the cables can be strung through a number of blocks in an array, or mat, parallel to the sides of the mat. This represents a rather unstable situation for the blocks, as they tend to rotate a small amount about the cables. This instability is alleviated by forming blocks with two parallel cable channels running East and West, and two other parallel cable channels running North and South. This reduces the instability of the blocks, and is suitable for blocks that are not of the interlocking type, such as disclosed in the patent identified above. Even with two parallel cables extending through each block in a N-S/E-W direction, the cables themselves tend to move with respect to each other in a torsional manner, thereby allowing the blocks to rotate a small amount. The rotation of interlocking blocks is undesirable, and should be avoided.

From the foregoing, it can be seen that a need exists for a method of cabling a plurality of erosion control blocks together to minimize rotation thereof. Another need exists for a method of cabling interlocking blocks together in a mat to minimize rotation of the individual blocks. Yet another need exists for a method of forming erosion control blocks with cable channels to accommodate the cabling methods disclosed herein.

SUMMARY OF THE INVENTION

In accordance with the principles and concepts of the invention, there is disclosed an erosion control block and a method of cabling a number of such blocks together in a matrix or mat.

In accordance with one embodiment of the invention, disclosed is a generally rectangular-shaped erosion control block adapted for cabling to other similar blocks, where the blocks have diagonal cable channels formed therethrough. With this arrangement of cable channels, the cables threaded through the cable channels exit the blocks at the respective corners thereof. The blocks of the mat are thus individually more stable and resistant to torsional movement.

In accordance with another feature of the invention, the erosion control blocks are of the interlocking type having male tabs that interlock with female sockets. The blocks each have a central opening through which the cables extend. The openings, especially at the side and edge blocks of the mat, facilitate attachment of the various cable ends to other cables of the mat.

In accordance with another aspect of the invention, cables are threaded through a matrix of erosion control blocks in a zig-zag manner and terminated at the edge of the matrix. The ends of the cables are terminated at desired edges of the mat so that a spreader bar can be attached thereto for lifting the mat. At other edges of the mat, and particularly at an edge or side where the mat is adjacent another mat, cable pigtails are attached to the threaded cables of the block. The cable pigtails of one mat are attached to the cable pigtails of an adjacent mat, thereby attaching the mats together.

According to an embodiment of the invention, disclosed is a cabling technique for forming a mat of erosion control blocks. The technique includes arranging a plurality of erosion control blocks in a rectangular-shaped mat having a first set of opposing sides and a second set of opposing sides. Blocks are used having at least two cable channels formed laterally through a heavy material forming the blocks, and the cable channels of each said block have an axial axis angled with respect to the sides of the mat. The cable is threaded through a cable channel of a plurality of the blocks such that one end of the cable terminates at a block located at one side of the mat, and another cable end terminates at a block located at an opposing side of the mat. The cable is thus threaded in a zig-zag path through cable channels of the blocks. The foregoing threading step is continued with a plurality of other cables until a cable has been threaded through each cable channel of each block of the mat.

In accordance with another embodiment of the invention, disclosed is a cabling technique for forming a mat of erosion control blocks, including (a) arranging a plurality of erosion control blocks in a rectangular-shaped mat having first and second opposing side edges and third and fourth opposing side edges; (b) threading a first cable through cable channels of a plurality of blocks of the mat so that the first cable zig zags diagonally through the mat, and free ends of the first cable are terminated at respective blocks located at the first and second opposing side edges of the mat; (c) threading a plurality of other cables in the same manner as set forth in step (b), whereby a plurality of cable ends terminate at blocks located at the first and second opposing side edges of the mat; and terminating the ends of the cables by attaching the cable ends to other cables.

In accordance with yet another embodiment of the invention, disclosed is a cabling technique for forming a mat of erosion control blocks, including arranging and interlocking a plurality of erosion control blocks in rows and columns to form a rectangular-shaped mat having a first set of opposing sides and a second set of opposing sides, where an axis of each block extends through a male tab member, and the axis is orthogonal to a side edge of the mat; using interlocking blocks of the type having at least two male tab members and two female socket members, the members structured such that when a male tab member of one block is interlocked with a female socket member of another block, the blocks cannot be laterally removed from each other; using interlocking blocks of the type having a central opening formed from a top surface of the block to a bottom surface thereof, and having cable channels extending laterally through each said block, where the cable channels of blocks located along a diagonal line through the mat are aligned, and the cable channels of each block intersect in the respective openings thereof; and threading one or more cables through the respective cable channels of the blocks such that the cables are routed along diagonal paths through the mat.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which:

FIGS. 9*a* and 9*b* are respective top views, one an enlarged view, of a portion of adjacent mats, showing in detail the manner in which the pigtail ends are connected together to thereby connect the mats together; and FIG. 10 illustrates another embodiment for connecting together adjacent mats of erosion control blocks.

DETAILED DESCRIPTION OF THE INVENTION

Figure 1:
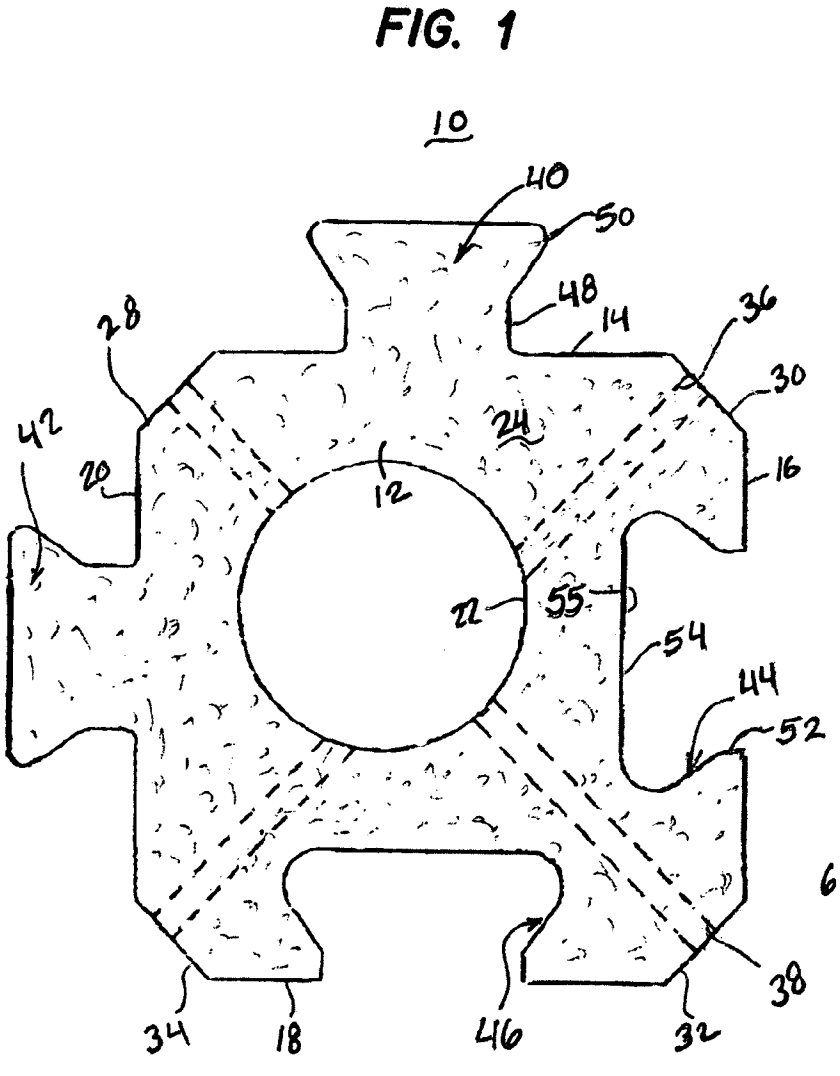
FIG. 1 is a top view of an erosion control block constructed according to the invention.
Figure 3:
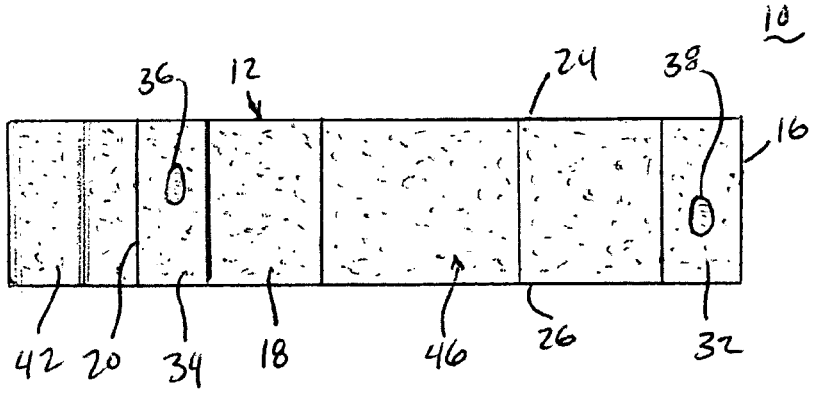
FIG. 3 is a side view of the erosion control block of FIG. 1.

With reference to FIGS. 1 and 3, there is shown respective top and side views of an erosion control block 10 constructed according to one embodiment of the invention. The block 10 includes a body 12 formed with a heavy material, such as concrete. Preferably, although not by necessity, the block 10 can be made by block plant techniques. In forming the erosion control block 10, the body 12 is formed with four sides, including a north side 14, an east side 16, a south side 18 and a west side 20. The north, east, etc., designations are merely to identify and describe the different attributes of the block 12, and do not reflect any actual directional or positioning requirements. In terms of size, the block 10 is about fifteen inches between the sides 16 and 20, and about fifteen inches between the sides 14 and 18. A block thickness of about 4.5 inches provides a weight of about sixty pounds. In order to achieve a heavier block, it can be made thicker. Formed in the body 12 of the block 10 is an opening 22 extending from the top surface 24 of the block 10 to the bottom surface 26 of the block 10. The central opening 22 allows vegetation to grow through the block 10 to assist in anchoring the block 10 to the ground. As will be described below, the central opening 22 also provides ready access to the cables extending therethrough.

The erosion control block 10 is constructed with each corner formed as a diagonal face. For example, the corner 28 is diagonal to the sides 14 and 20. The corner 30 is diagonal to the sides 14 and 16, and the corner 32 is diagonal to the sides 16 and 18. Lastly, the corner 34 is diagonal to the sides 18 and 20. In the preferred form of the invention, the corners are made diagonal with an angle of about 45 degrees. As will be described in more detail below, when blocks are arranged in a mat, the diagonal corners of four adjacent blocks form a square opening in the mat.

In accordance with an important feature of the invention, cable channels are formed diagonally between opposite corners of the block. For example, a first cable channel 36 is formed through the body 12 of the block 10 from diagonal corner 30 to the opposite diagonal corner 34. Similarly, a second cable channel 38 is formed between diagonal block corners 28 and 32. Accordingly, only two cable channels are utilized to provide stability to each block 10 in the mat. The cable channels 36 and 38 are about 0.75 inch in diameter to accommodate at least two cable ropes, each of about 0.25 inch in diameter. As noted in FIG. 1, each cable channel 36 and 38 extends through the central opening 22 of the block 10. This not only facilitates threading of synthetic rope cables through the blocks 10, but allows attachment of cable pigtail ends thereto in order to tie the edge blocks of one mat to the edge blocks of an adjacent mat. The cable channels 36 and 38 are formed orthogonal to each other, but the intersection of the cable channels 36 and 38 is not in the center of the central opening 22. This is because the central opening 22 is not in the center of the body 12, but rather is offset toward the west side 20. The cable channels 36 and 38 can be formed in the blocks using core puller rods extending horizontally through the block plant form. After the concrete has been poured into the form, the core puller rods can be removed, thereby leaving the cable channels extending through the blocks. It can also be appreciated that the cable channels 36 and 38 are formed at different elevations in the block 10, as shown in FIG. 3.

In the preferred embodiment of the invention, the erosion control block 10 is formed with members for interlocking with four adjacent blocks. First and second male tab members 40 and 42 are formed on respective sides 14 and 20. First and second female socket members 44 and 46 are formed into respective sides 16 and 18. The male tab member, for example tab member 40, is formed with a neck portion 48 connecting an enlarged end 50 to the side 14. The female socket member, such as socket member 44, is formed with a narrow opening 52 in the side 16, which opens into a larger socket 54. The narrow opening 52 of the female socket member 44 accommodates the neck portion 48 of another block (not shown), and the socket 54 accommodates the enlarged end 50 of a tab member of the adjacent block. When the male tab member 40 of one block is inserted into the female socket member 44 of an adjacent block, the two blocks become positively engaged in an interlocking manner and cannot be laterally removed from each other. Four neighboring blocks can be interlocked to the block 10 in the manner described. In other embodiments, the male tab members 40 and 42 can be formed on opposite sides of the body 12 of the block 10, as can be the female socket members 44 and 46.

The central opening 22 of each block 10 is offset, as noted above. In practice, the central opening 22 is centered between the west side 20 of the body 12 of the block 10, and the inner sidewall 55 of the female socket member 44. The central opening 22 is formed centrally between the north side 14 and the south side 18 of the body 12 of the block 10.

Figure 2:
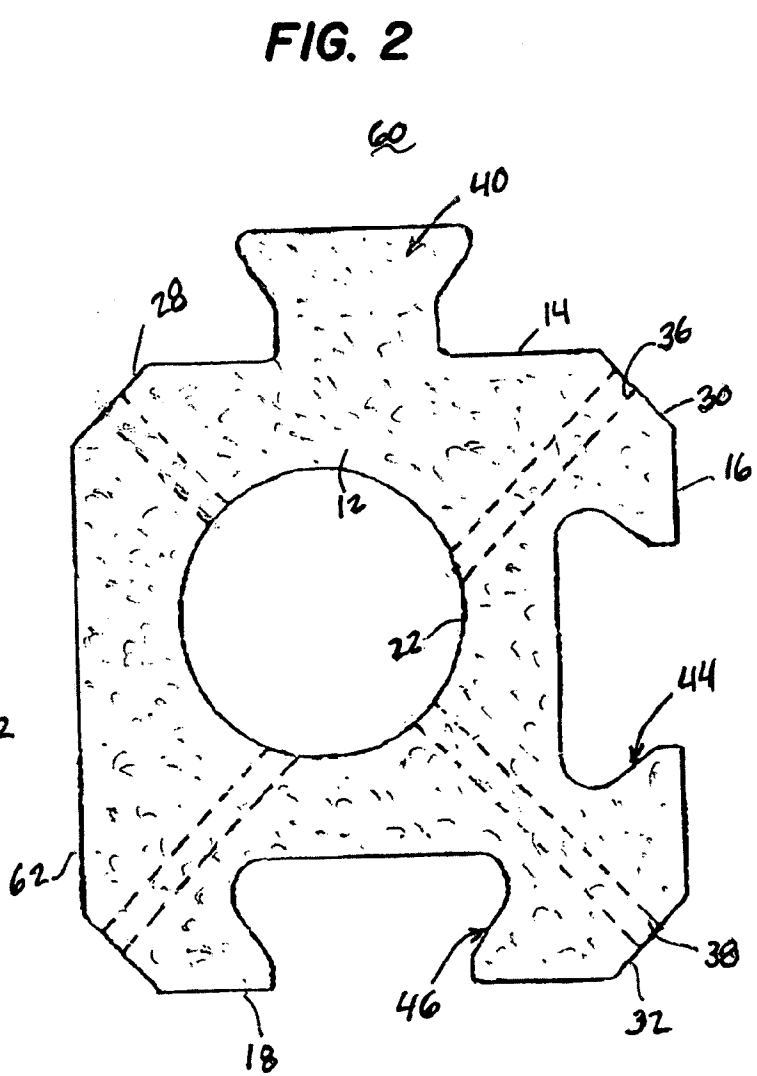
FIG. 2 is a top view of an edge block constructed according to the invention.

All of the erosion control blocks 10 of a mat are of the type shown in FIG. 1, with the exception of the blocks on one edge of the mat. FIG. 2 illustrates an edge block 60 used on one edge of a mat. The edge block 60 is substantially identical to the block 10, except the edge block 60 is constructed with only one male tab member 40. The side of the block 60 opposite the female socket member 44 is a planar side 62, without either a male or female member. The block 60 can be constructed by simply sawing the male tab member 42 off the block 10. Alternatively, the edge block 60 can be formed by block plant or other means without the male tab member 42. When an edge of a mat having the edge blocks 60 is placed adjacent another mat of blocks, the absence of the male members on the edge blocks allows easy attachment of the adjacent mats together using cable pigtail ends. This will be described in more detail below. More importantly, the absence of a male tab member extending from the edge of the mat allows easy placement of mats close together, without having to "zipper" the male/female members of the mats together in an interlocking manner. The side of an adjacent mat would have blocks with female socket members. Thus, there is no male/female interlocking relationship between the mats of a system.

Figure 4:
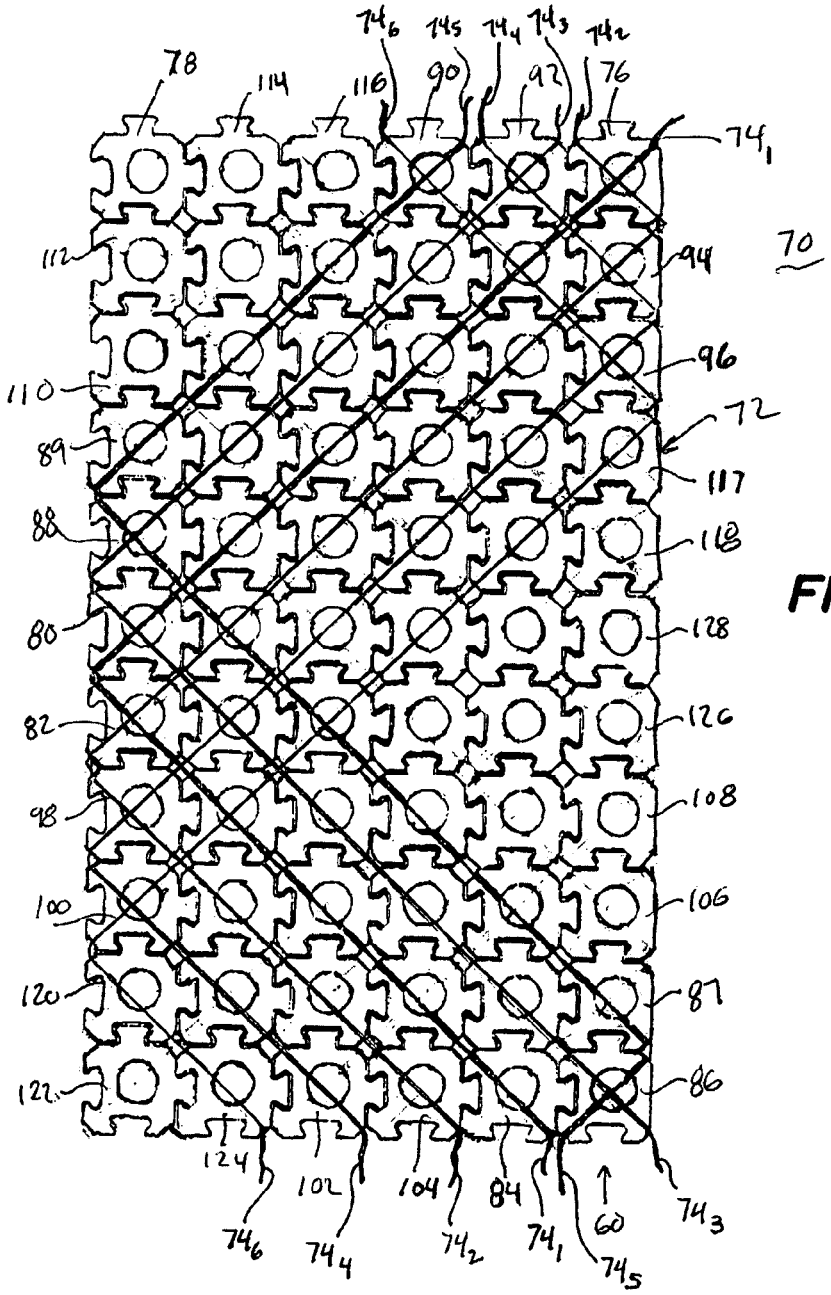
FIG. 4 is a top view of a mat of blocks partially cabled together with six cables.

FIG. 4 illustrates a partially cabled mat 70 of erosion control blocks arranged according to the invention. The mat 70 of the example is an eleven by six matrix of blocks 10. Mats of many other matrix sizes can be cabled together using the various methods of the invention. A majority of the blocks are the type 10 shown in FIG. 1, with the exception of the edge 72, which includes the edge blocks 60 shown in FIG. 2. The cabling of the blocks of the mat 70 includes a plurality of cables, preferably of the synthetic rope type. A first cable 74, is shown threaded in a zig-zag manner through one cable channel of eleven blocks of the mat 70. In the preferred form of the invention, twelve separate cables $\mathbf{74}_1$–$\mathbf{74}_{12}$ are used to provide a complete zig-zag cabling of the six-by-eleven mat 70 of blocks 10.

The first cable $\mathbf{74}_1$ is threaded through the blocks in the following manner. The cable $\mathbf{74}_1$ is first threaded through one cable channel of the top corner block 76, and then through the cable channels of all the other intermediate blocks to the side block 80, down to adjacent side block 82, and then diagonally down through other blocks to the bottom block 84. The end of the cable $\mathbf{74}_1$ is left extending from the bottom block 84 until secured in a manner described below. The second cable $\mathbf{74}_2$ is threaded through the other cable channel of the top corner block 76, down to adjacent edge block 94, diagonally down to side block 82, down to adjacent side block 98, and then diagonally down to bottom block 104. Much like the end of cable $\mathbf{74}_1$ in bottom block 84, the end of cable $\mathbf{74}_2$ extends a short distance from the cable channel of the bottom block 104. The end of each of the twelve cables extends from the respective blocks, and are terminated, as described below. The third cable $\mathbf{74}_3$ is threaded through the cable channel of top block 92, diagonally down to side block 88, down to adjacent side block 80, and then diagonally down to bottom corner block 86. The fourth cable $\mathbf{74}_4$ is threaded through the other cable channel of top block 92, diagonally down to edge block 94, down to adjacent edge block 96, diagonally down to side block 98, down to adjacent side block 100, and then diagonally down to bottom block 102. The fifth cable $\mathbf{74}_5$ is threaded through the cable channel of top block 90, diagonally down to side block 89, down to adjacent side block 88, diagonally down to edge block 87, down to adjacent bottom corner block 86, and then diagonally through the bottom corner block 86. The sixth cable $\mathbf{74}_6$ is threaded through the other cable channel of top block 90, diagonally down to edge block 96, down to adjacent edge block 117, diagonally down to side block 100, down to adjacent side block 120, and then diagonally down to bottom block 124. The zig-zag threading pattern of the six cables $\mathbf{74}_1$–$\mathbf{74}_6$ through the blocks of the mat 70 is apparent from FIG. 4.

Figure 5:
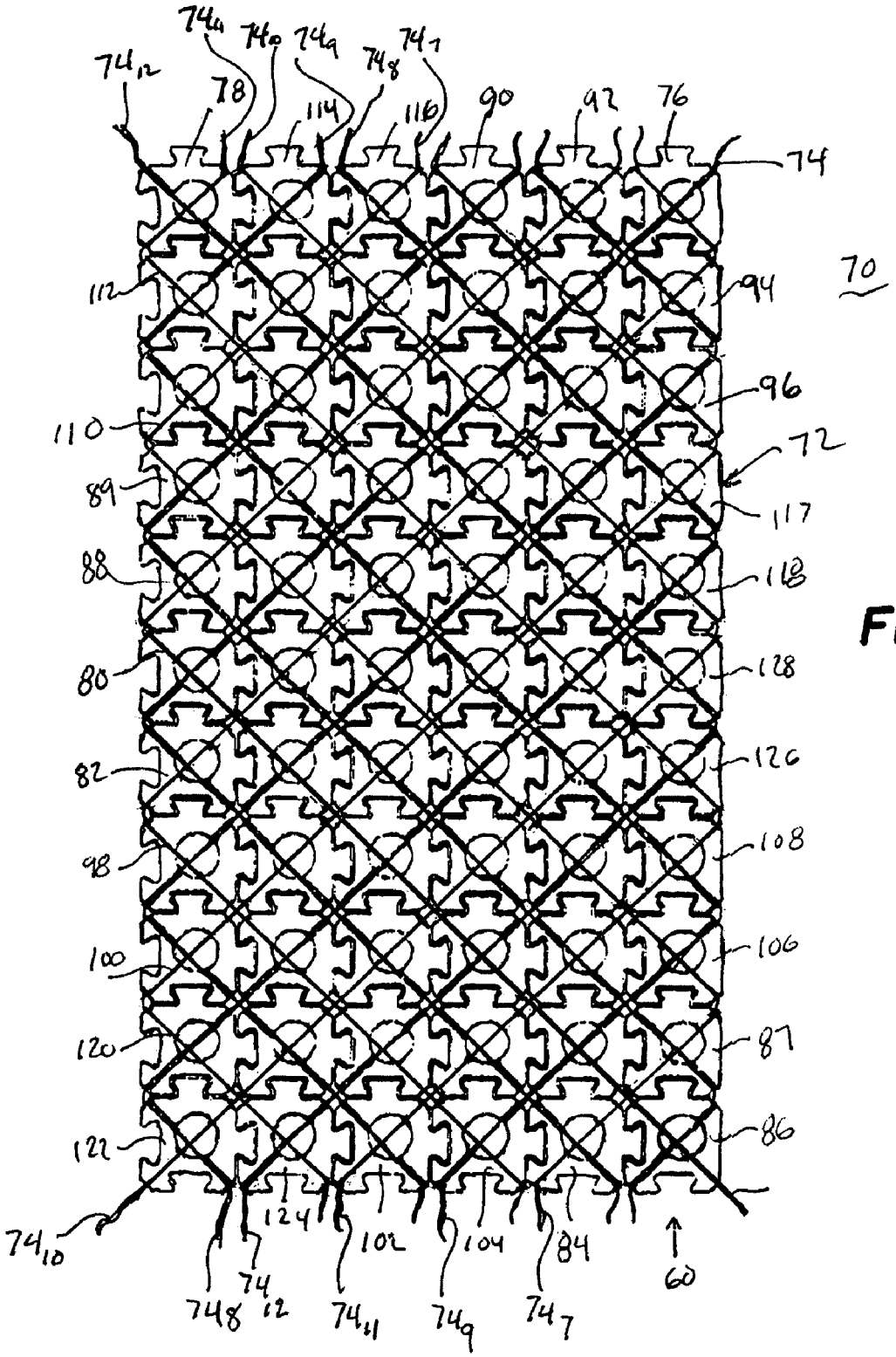
FIG. 5 is a top view of the mat of blocks of FIG. 4, but completely cabled together using a full set of twelve cables.

The remaining six cables $\mathbf{74}_7$–$\mathbf{74}_{12}$ are threaded through the blocks of the mat 70, as shown in FIG. 5. The seventh cable $\mathbf{74}_7$ is threaded through the cable channel of top block 116, diagonally down to side block 110, down to adjacent side block 89, diagonally down to edge block 106, down to adjacent edge block 87, and then diagonally down to bottom block 84. The eight cable $\mathbf{74}_8$ is threaded through the other cable channel of top block 116, diagonally down to edge block 117, down to adjacent edge block 118, diagonally down to side block 120, down to adjacent bottom corner block 122, and then diagonally through the cable channel of the bottom corner block 122. The ninth cable $\mathbf{74}_9$ is threaded through the cable channel of top block 114, diagonally down to side block 112, down to adjacent side block 110, diagonally down to edge block 108, down to adjacent edge block 106, and then diagonally down to bottom block 104. The tenth cable $\mathbf{74}_{10}$ is threaded through the other cable channel of top block 114, diagonally down to edge block 118, down to adjacent edge block 128, and then diagonally down to and through bottom corner block 122. The eleventh cable $\mathbf{74}_{11}$ is threaded through the cable channel of top corner block 78, down to adjacent side block 112, diagonally down to edge block 126, down to adjacent edge block 108, and then diagonally down to the bottom block 102. The twelfth cable $\mathbf{74}_{12}$ is threaded through the other cable channel of top corner block 78 and diagonally down to edge block 128, down to adjacent edge block 126, and then diagonally down to bottom block 124. As can be seen from FIG. 5, all blocks of the mat 70 are cabled in a zig-zag manner.

After the cables $\mathbf{74}_1$–$\mathbf{74}_{12}$ are threaded through the channels of the blocks in the manner noted, each block is constrained against rotational movement while suspended in the mat 70. By cabling the blocks diagonally therethrough with two cables, it is expected that fewer blocks will be damaged or broken due to torsional twisting while suspended in the mat 70.

Figure 6:
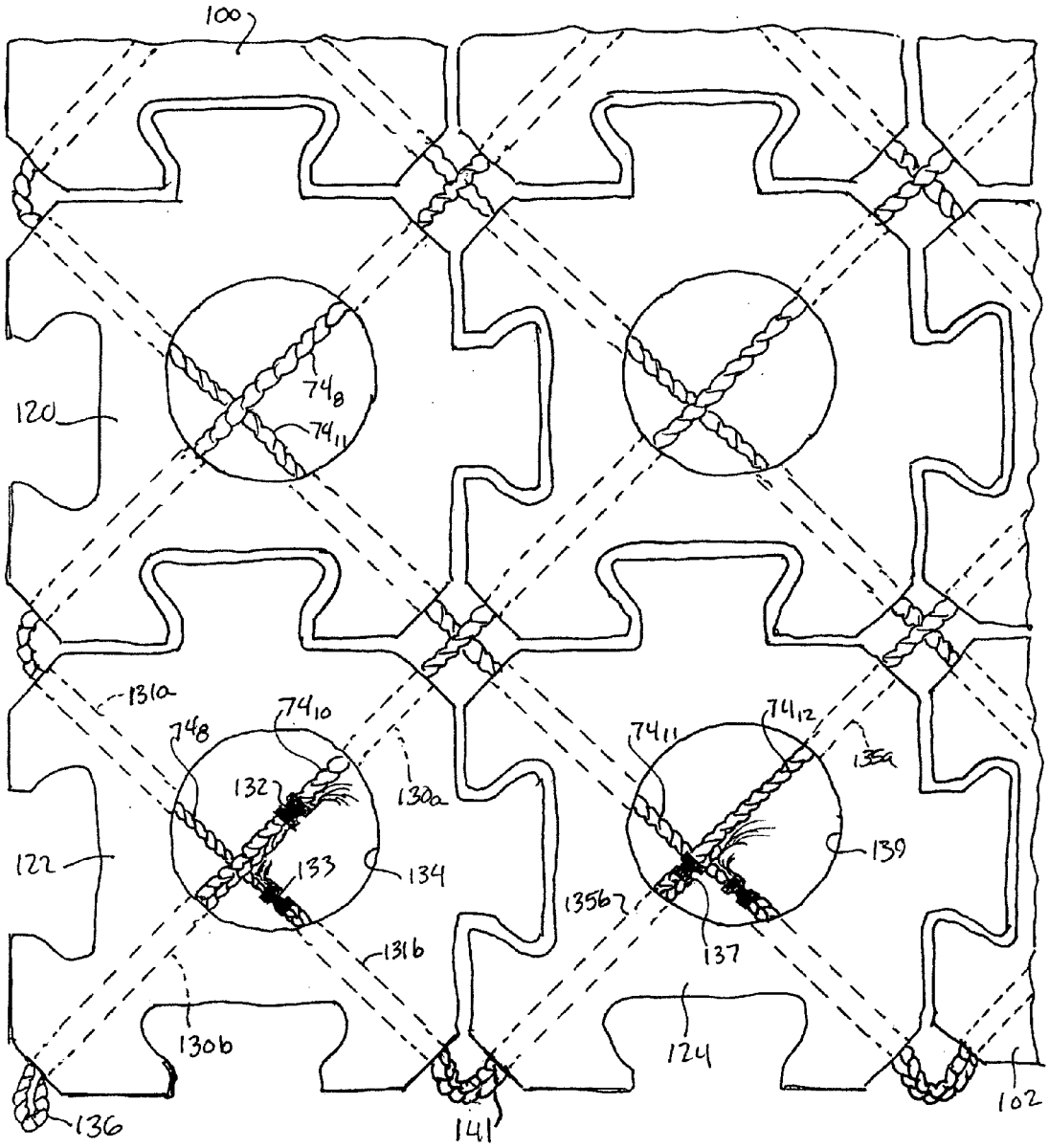
FIG. 6 illustrates the blocks of the bottom, left corner of the mat of FIG. 5, showing the manner in which the various cables are terminated and secured to hold the blocks together.

After the cables $\mathbf{74}_1$–$\mathbf{74}_{12}$ have been threaded through the blocks of the mat 70, the ends thereof are secured in different ways, depending on the position of the block in the mat 70. The cables extending from the top and bottom corner blocks are secured to form loops. The other top and bottom blocks are secured together with cable pairs, to also form loops. An example of the manner in which the cable ends of the corner blocks, and top and bottom blocks, are secured is shown in FIG. 6. Each corner block is secured in the same way. In threading a corner cable, for example cable $\mathbf{74}_{10}$ in FIG. 6, the end of the cable is threaded through the top diagonal part 130*a* of the cable channel and into the central opening 134 of the corner block 122. A sleeve 132 is then slipped over the end of the cable $\mathbf{74}_{10}$, and the remainder of the cable $\mathbf{74}_{10}$ is threaded through the bottom diagonal part 130*b* of the cable channel. The end of the cable $\mathbf{74}_{10}$ extending from the bottom corner block 122 is made into a loop 136, and the end of the cable $\mathbf{74}_{10}$ threaded back through the bottom diagonal part 130*b* of the cable channel and into the opening 134 of the corner block 122. In the opening 134, the end of the cable $\mathbf{74}_{10}$ is threaded through the sleeve 132, and the sleeve 132 is double crimped around both portions of the cable $\mathbf{74}_{10}$. The loop 136 of the cable $\mathbf{74}_{10}$ is a point of attachment with the heavy duty hook of a spreader bar. As noted above, the cable ends of the other corner blocks are secured in the same manner.

The cable ends of the top and bottom blocks of the mat 70 are secured so as to also provide respective points of attachments for spreader bar hooks. As an example, the cables $\mathbf{74}_8$ and $\mathbf{74}_{12}$ threaded through respective bottom corner block 122 and bottom block 124 are secured in the following manner. During the cable threading procedure, the cable $\mathbf{74}_8$ is threaded through the top part 131*a* of the cable channel of corner block 122. A sleeve 133 is then slipped over the cable end, and the remainder of the cable $\mathbf{74}_8$ is threaded through the lower part 131*b* of the cable channel of bottom corner block 122. The end of the cable $\mathbf{74}_8$ is then threaded through the lower part 135*b* of the cable channel of the bottom block 124 and into the opening 139 thereof.

The end of the other cable $\mathbf{74}_{12}$ is threaded in a similar manner so as to have a sleeve 137 on it in the opening 139 of bottom block 124, and with the end of cable $\mathbf{74}_{12}$ extending into the opening 134 of bottom corner block 122. The bottom parts 131*b* and 135*b* of the respective cable channels thus have two cables threaded therethrough. The end of cable $\mathbf{74}_8$ is threaded through the sleeve 133 in the opening 134 of the bottom corner block 122. The cable $\mathbf{74}_8$ and the end of cable $\mathbf{74}_{12}$ are secured together by double crimping the sleeve 133 thereto. Similarly, the cable $\mathbf{74}_{12}$ and the end of cable $\mathbf{74}_8$ are secured together in the opening of bottom block 124 by double crimping the sleeve 137 thereto. The way the pair of cables $\mathbf{74}_8$ and $\mathbf{74}_{12}$ are secured provides a short loop 141 of two cables at the bottom edge of the mat 70 for attachment by the hook of a spreader bar. The cable pairs of the other top and bottom blocks of the mat 70 are secured in the same manner. The top edge and the bottom edge of the mat 70 are thus provided with multiple points of attachment with the hooks of the spreader bars. When a spreader bar is attached to the top edge of the mat 70, and another spreader bar is attached to the bottom edge of the mat 70, via the respective points of attachment, the spreader bars are lifted by a crane. During the process in which the mat 70 is lifted and moved to the location to be installed, the mat 70 bows downwardly. It is at this time that the interlocked blocks of the mat 70 are forced together, thereby subjecting the blocks to pressure against each other, torsional twisting, and possible damage. With the utilization of the invention, block damage is substantially reduced due to the inability of the individual blocks to twist, rotate or turn.

As an alternative to the termination of the cable ends described in connection with FIG. 6, it is also possible to attach the ends of a pair of cables together in only one opening of a block. For example, those skilled in the art may prefer to thread cable $\mathbf{74}_8$ through the cable channel 131*a* and terminate the cable end in the opening 134 of corner block 122. On the other hand, the end of cable $\mathbf{74}_{12}$ would be threaded through both cable channels 135*a* and 135*b* of bottom block 124, and through cable channel 131*b* of corner block 122, and terminate the end thereof in the opening 134 of corner block 122. The free ends of the cables $\mathbf{74}_8$ and $\mathbf{74}_{12}$ would be attached together in the opening 134 using one or more double crimped sleeves.

Those skilled in the art may find that the starting of the cable threading can be initiated at the sides of the mat, and zig-zag laterally across the mat. For example, the first cable would start at the right, top corner of the mat, and thread the cable diagonally until it reaches the left side of the mat. The remaining cables would be started at the other cable channels at the right side of the mat, and zig-zag across the mat until terminated at the left side of the mat. Some of the cable will only extend diagonally and not zig-zag. While this alternative requires shorter cables, it does require more cables. The cable ends can be secured at the sides of the mat in the manner described above. The use of more cables does, however alleviate the need to thread a long length of one or more cables through many cable channels, which may be more time consuming.

As an alternative to the cabling technique described above, those skilled in the art may find that two cables can be used with the mat 70, which cables would be substantially longer than that described above. In this embodiment, the first cable could be threaded first through a top right corner block, and zig-zag in mat through one cable channel of each block of the mat 70 until the cable exits the top left corner block. The other cable could start at a bottom right corner block and be threaded in a zig-zag manner through the other cable channel of each block of the mat 70 and exit the bottom left corner block. With this cable threading scheme, each cable would be threaded through a cable channel of each block of the mat 70, irrespective of the length or width of the mat 70.

While various cable threading techniques have been described, those skilled in the art may find yet other threading arrangements to be advantageous. As a further example, one may thread one or more cables through only the first diagonals of the mat (upper right to lower left), and then use one or more other cables for threading through the other diagonals (upper left to lower right). In this case, no cable itself is threaded in a zig-zag manner. The various cable threading arrangements can accommodate many different mat widths and lengths, and thus numbers of blocks in a mat. Thus, if different size mats are required for different area requirements, then it is an easy task to determine the number of blocks required to cover the area, the number of columns and rows in the mat, and then cable the mats according to the threading techniques of the invention. Many other arrangements are possible, including variations and combinations of the cable threading techniques described herein.

Figure 7:
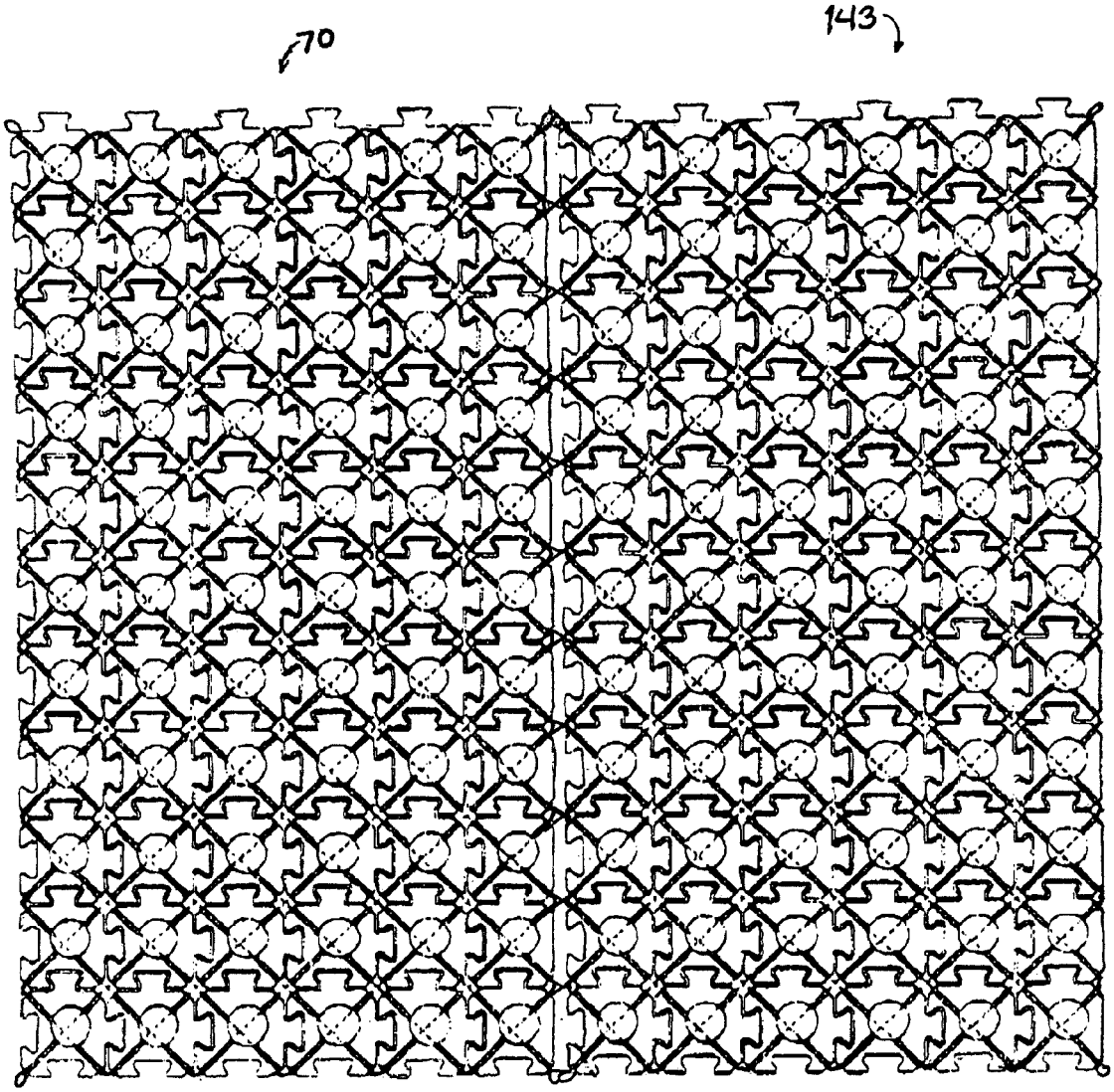
FIG. 7 is a top view of two mats cabled together.

FIG. 7 illustrates two mats 70 and 143 of erosion control blocks individually cabled together according to the technique described above in connection with FIG. 5. The mats 70 and 143 are lowered to the location to be protected against erosion, and laid adjacent each other, as shown. In order to provide a system of mats tied together, the side edges of the adjacent mats are secured together with short cables and tied together to provide an overall integrity throughout the system of mats. While only two mats 70 and 132 are shown in FIG. 7, many other mats can be attached together in the same manner to provide a large area of ground coverage and prevent erosion thereof. Since the cables $\mathbf{74}_1$–$\mathbf{74}_{12}$ used to cable a mat together are routed between adjacent blocks at the side edges of the mat 70, no free cable ends are available that can be used to tie or otherwise attach the mats together. Accordingly, pigtail cable ends are provided at a plurality of locations between adjacent mats to attach the mats together after they have been placed together at the desired location.

Figure 8:
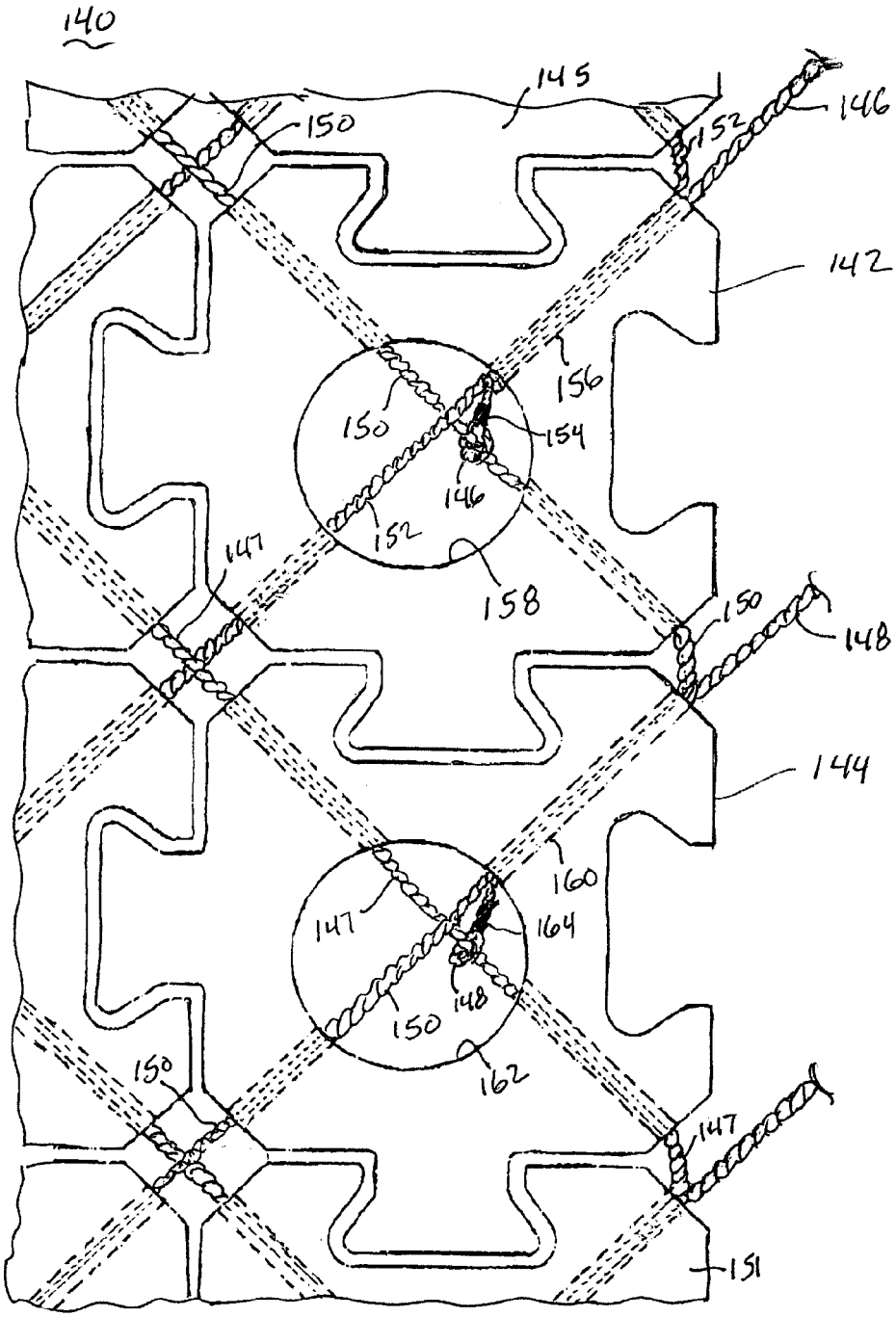
FIG. 8 is a top view of an enlarged portion of a mat of FIG. 5, showing the cable pigtail ends extending from the side blocks of the mat.

FIG. 8 illustrates a configuration 140 of erosion control blocks of a mat, where the side blocks 142 and 144 are provided with respective pigtail cable ends 146 and 148. The other side blocks and edge blocks of the mat can be provided with pigtail cable ends in a similar manner. The side block 145 is cabled to adjacent side block 142 by cable 152, in the manner described above. The cable 152 effectively zigs through side block 145, is looped, and then zags through side block 142 to form a zig-zag pattern. In like manner, the cable 150 is threaded through both side blocks 142 and 144. Cable 147 is threaded through adjacent side blocks 144 and 151. In order to provide free cable ends, a short length of cable is attached to each of the cables 147, 150 and 152 at the location of each side block. For example, a cable pigtail 146 of about eighteen inches long is attached to the cable 150. The end of the cable pigtail 146 is looped around the cable 150, and fastened to itself by a sleeve 154. The sleeve 154 is aluminum, is commercially available, and made for crimping synthetic rope-type cables together. In practice, the sleeve 154 is double crimped for purposes of reliability. The cable channel 156 formed in block 142 is of sufficient diameter to accommodate two cables threaded therethrough. Importantly, the connection between the cable pigtail 146 and cable 150 is made inside the opening 158 of the side block 142. The opening 158 formed in the block 146 provides excellent accessibility to, and room for crimping a connection for achoring the two cables together. The free end of the cable pigtail 146 is available for attachment to an adjacent mat of blocks.

Another cable pigtail 148 is provided by threading a short piece of cable through the cable channel 160 of side block 144. The end of the cable pigtail 148 is looped around the cable 147 and fastened to itself by a crimped sleeve 164. The connection between the cable pigtail 148 and the cable 147 is made in the opening 162 of the side block 144. The free end of the cable pigtail 148 is available for attachment to the adjacent mat of blocks. Cable pigtails can be attached to the other cables exposed at the edge blocks and the side blocks of the mat in a similar manner. Accordingly, each side of the mat is provided with free cable ends for connection to adjacent mats.

FIG. 9*a* illustrates the manner in which the adjacent mats are connected together using the cable pigtails. The block arrangement 140 is associated with a first mat, and the block arrangement 170 is associated with a second, adjacent mat. The block arrangement 170 includes edge blocks 172 and 174, with respective openings 176 and 178 formed therein. A cable pigtail 180 is crimped by a sleeve 182 around cable 183. Similarly, a cable pigtail 184 is crimped by a sleeve 186 around cable 187 in the opening 178 of edge block 174.

FIG. 9*b* is an enlarged view illustrating the manner in which the cable pigtail of one mat is attached to the cable pigtail of an adjacent mat. At the corner formed by side blocks 142 and 144, and edge blocks 172 and 174, there is formed a square opening 190. The free ends of the cable pigtails 148 and 184 are available in the opening 190. A sleeve 192 is placed around the free ends of the cable pigtails 148 and 184 and double crimped thereto. Each of the cable pigtails of the side blocks of the configuration 140 are attached to the cable pigtails of the block configuration 170 in a similar manner. The respective cables 150 of the one mat and the cable 183 of the adjacent mat are thus attached together and separation of the mats is prevented.

While each side and edge block of the preferred embodiment are pigtailed, those skilled in the art may find that in some applications, not every side and corresponding edge block need be pigtailed. Rather, the pigtailing of every other side and edge block may be sufficient. As an alternative to the use of cable pigtails, the cables of each mat can be connected together by using a short cable 212, as shown in FIG. 10. Here, the cable 204 is threaded between side blocks 200 and 202 of a mat in the same manner as described above in connection with FIG. 5. An adjacent mat has edge blocks 206 and 208 held together with a cable 210. In order to attach the side blocks of one mat to the edge blocks of an adjacent mat, a single short length of cable 212 is wrapped around that portion of the cables 204 and 210 exposed in the square opening 216. The ends of the short cable 212 are attached together by crimping one or two sleeves 214 thereto. Depending on the situation, the short cable 212 can be wrapped around the exposed cables 204 and 210 of adjacent mats twice. The exposed portions of the other cables of the adjacent mats can be attached together in a similar manner.

The foregoing description contemplates that the mats of erosion control blocks are made with a sufficient number of blocks in length such that the mats only need to be attached at the sides and edges in order to make a system of mats. This arrangement functions adequately when the ground area to be covered is much longer in one dimension than the other. When large areas, both as to length and width, are required to be covered with the mats of erosion control blocks according to the invention, then the mats need to be attached to each other not only at the sides, but also at the top and bottom edges. Mats of erosion control blocks cannot generally be made with extremely long widths or lengths because of weight considerations, as well as the size of the cables required to carry the corresponding load. To that end, the top and bottom ends of the mats can be attached together with cable pigtail ends, much like that described above in conjunction with FIGS. 8 and 9. In this situation, the cable channels of the blocks would have to accommodate three cables. Nevertheless, the mats can be attached together in a large two dimensional erosion prevention system to cover a large surface area of the ground.

In the contemplated applications, it is expected that the mats of erosion control blocks would be lifted and moved using a crane and a spreader bar. However, the erosion control blocks can be hand laid at the location, and ropes threaded through the blocks in the same zig-zag manner described above. The mats can also be attached together at the sides thereof using the techniques set forth above.

From the foregoing, disclosed is an erosion control block and a method of cabling the same together to provide a mat of blocks, where each block of the mat is suspended by a pair of cables which exit the blocks at the corners thereof. Disclosed also is a technique for cabling together adjacent mats of erosion control blocks to provide a large area of coverage and prevent erosion of the underlying ground. While the invention is described in connection with a preferred embodiment using interlocking blocks, the utilization of the invention does not require that the blocks be of the interlocking type. Rather, block design that are not interlocking at all, such as the type described in U.S. Pat. No. 4,375,928 by Crow et al., and blocks that are only interengaging, such as disclosed in U.S. Pat. No. 5,020,938 by Scales and U.S. Pat. No. 6,484,230 by Rudloff, can be utilized with the principles and concepts of the invention.

While the preferred and other embodiments of the invention have been disclosed with reference to specific blocks and cabling techniques, it is to be understood that many changes in detail may be made as a matter of engineering choices without departing from the spirit and scope of the invention, as defined by the appended claims.

What is claimed is:

1. A cabling technique for forming a mat of erosion control blocks, comprising the steps of:

arranging a plurality of erosion control blocks in a rectangular-shaped mat having a first set of opposing sides and a second set of opposing sides;

using blocks having at least two cable channels formed laterally through a heavy material forming said blocks, the cable channels of each said block having an axial axis angled with respect to the sides of said mat;

threading at least one cable through a cable channel of a plurality of said blocks such that one end of said cable terminates at a block located at one side of said mat, and such that another end of said cable terminates at a block located at a different side of said mat, said cable threaded in a zig-zag path through cable channels of the blocks; and threading a plurality of other cables through respective cable channels of blocks of the mat.

2. The method of claim 1, further including carrying out said threading step so that at least one cable exits a cable channel of one block, and is routed in a different direction through a cable channel of an adjacent block.

3. The method of claim 1, further including using blocks having a respective central opening formed therethrough from a top surface to a bottom surface of each said block.

4. The method of claim 3, further including connecting together an end of a cable with another cable in a respective opening of a block in such a manner that two cables are threaded through at least a portion of a cable channel of the block.

5. The method of claim 4, further including connecting together an end of a cable with another cable in respective openings of blocks located on a side of the mat opposite said one side.

6. The method of claim 4, further including connecting the cable to another cable end using a sleeve crimped thereto.

7. The method of claim 3, wherein said mat has corner blocks, and a cable channel opens at each corner of each said corner block, and further including threading a cable through a cable channel of each corner block to the outside of the respective corner block, forming a loop in said cable, and threading the cable back through the same cable channel so that an end of the cable is in the central opening of said corner block.

8. The method of claim 7, further including fastening the cable end to the cable in the central opening, and using a sleeve crimped thereto.

9. A cabling technique for forming a mat of erosion control blocks, comprising the steps of:

(a) arranging a plurality of erosion control blocks in a rectangular-shaped mat having first and second opposing side edges and third and fourth opposing side edges;

(b) threading a first cable through cable channels of a plurality of blocks of the mat so that the first cable zig zags diagonally through the mat, and terminating free ends of the first cable at respective blocks located at the first and second opposing side edges of the mat;

(c) threading a plurality of other cables in the same manner as set forth in step (b), whereby a plurality of cable ends terminate at blocks located at said first and second opposing side edges of the mat; and terminating the ends of the cables by attaching the cable ends to other cables.

10. The method of claim 9, further including using erosion control blocks having a central opening formed from a top surface to a bottom surface thereof, and where first and second cable channels extend laterally through said block, into the central opening.

11. The method of claim 10, wherein the cable ends of a pair of cables are attached together in the central opening of one said block.

12. The method of claim 10, further including threading a first cable through a cable channel of one block and terminating the first cable in a central opening of a second block, and threading a second cable through a cable channel of the second block and terminating the second cable in the central opening of the first block, and attaching the first and second cables together in the openings of both said first and second blocks.

13. The method of claim 9, further including threading a cable from one block located on said third side edge to an adjacent block located on said third side edge, whereby a cable loop is formed between said adjacent blocks.

14. The method of claim 13, further including a plurality of said cable loops, each said cable loop located between adjacent blocks located on said third side edge, and further including using said loops to fasten said mat of erosion control blocks to another mat of erosion control blocks.

15. The method of claim 10, wherein blocks located at said third side edge of the mat have cables extending through cable channels thereof, and said cables are criss-crossed in the central openings.

16. The method of claim 15, wherein each said cable channel of said blocks includes a first part extending from a corner of the block to the central opening, and a second part extending from the opening to an opposite corner of the block, an axial axis of the first and second parts of each said cable channel being collinear.

17. The method of claim 16, further including threading an end of a short cable through the first part of a cable channel of a block located at said third side edge of the mat, looping the end of the short cable around one of the criss-crossed cables in the opening of the block, and fastening the end of the short cable to itself in the central opening of the block, thereby anchoring the short cable around said one cable of the criss-crossed cables.

18. The method of claim 9, further including using as many cables as there are cable channels extending outwardly from blocks located at said first side edge of the mat.

19. A cabling technique for forming a mat of erosion control blocks, comprising the steps of:

arranging and interlocking a plurality of erosion control blocks in rows and columns to form a rectangular-shaped mat having a first set of opposing sides and a second set of opposing sides, an axis of each block extending through a male tab member, and said axis being orthogonal to a side edge of the mat;

using interlocking blocks of the type having at least two male tab members and two female socket members, said members structured such that when a male tab member of one block is interlocked with a female socket member of another block, the blocks cannot be laterally removed from each other;

using interlocking blocks of the type having a central opening formed from a top surface of the block to a bottom surface thereof, and having cable channels extending laterally through each said block, where the cable channels of blocks located along a diagonal line through the mat are aligned, and the cable channels of each block intersect in the respective openings thereof; and threading one or more cables through the respective cable channels of the blocks such that the cables are routed along diagonal paths through the mat.

20. A mat of erosion control blocks cabled together as set forth in claim 19.

21. The cabling technique of claim 19, further including using 2N different cables in forming the mat, where N is the number of blocks in a single row of the mat, and routing at least some of the cables in a zig-zag path through the cable channels of the blocks of the mat.

22. The cabling technique of claim 21, further including routing the cables through the cable channels of the blocks of the mat so that the ends of each cable terminate at opposite sides of the first set of opposing sides of the mat, wherein each cable has a first end and a second end, and the first ends of the cables all terminate on one side of the first set of opposing sides of the mat and the second ends of the cables all terminate on the opposite side of the first set of opposing sides of the mat.

* * * * *